US006411183B1

(12) United States Patent
Yamagata et al.

(10) Patent No.: US 6,411,183 B1
(45) Date of Patent: Jun. 25, 2002

(54) CIRCUIT BREAKER

(75) Inventors: Hideto Yamagata; Naoshi Uchida; Koji Asakawa, all of Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/985,469

(22) Filed: Nov. 2, 2001

(30) Foreign Application Priority Data

Nov. 6, 2000 (JP) ..... 2000-337552

(51) Int. Cl.[7] ..... H01H 75/00
(52) U.S. Cl. ..... 335/6; 335/13; 335/17
(58) Field of Search ..... 335/6, 13–15, 335/17, 21–46, 159–163

*Primary Examiner*—Ramon M. Barrera
(74) *Attorney, Agent, or Firm*—Kanesaka & Takeuchi

(57) ABSTRACT

A circuit breaker of the invention is formed of an attached switch installed in a breaker main body case and moving synchronously with an opening and closing lever of an opening and closing mechanism section to detect ON or OFF status of the circuit breaker. The attached switch has an operating lever moving vertically and placed opposite a tip of the opening and closing lever when the attached switch is installed in the main body case. The operating lever has an interlocking hook additionally provided thereon and linked with the opening and closing lever so as to hook the tip thereof, and an attached switch housing section formed in the main body case has a hook guide at a bottom thereof for guiding, in a position where the attached switch is installed, the interlocking hook to a position where the interlocking hook engages the opening and closing lever.

6 Claims, 4 Drawing Sheets

Fig. 1(a)
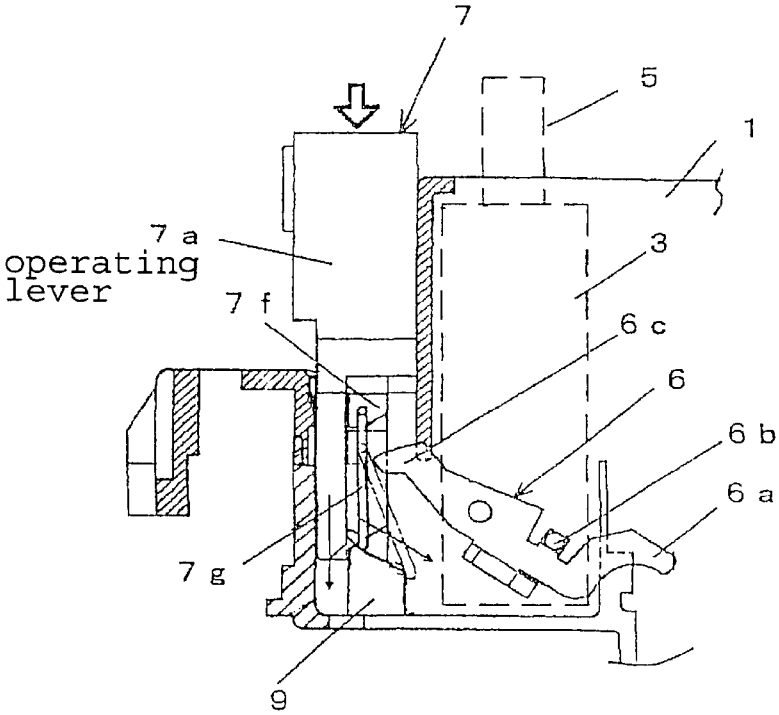
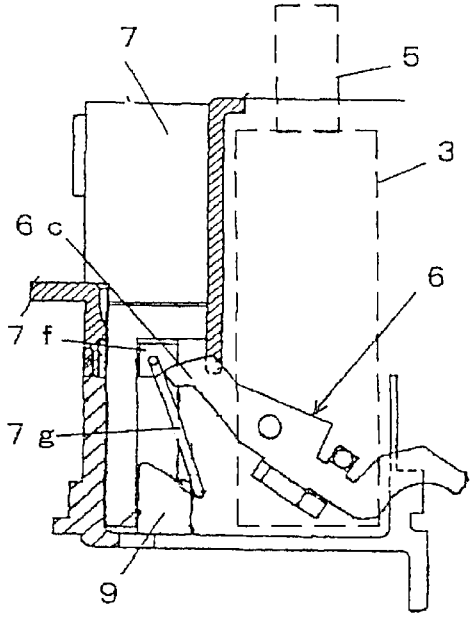
Fig. 1(b)
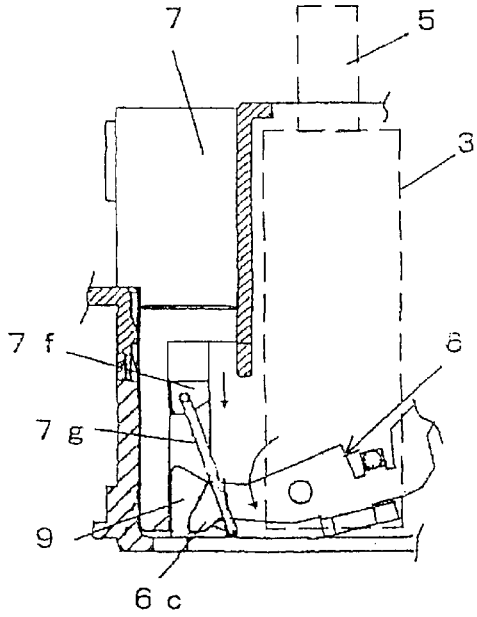
Fig. 1(c)

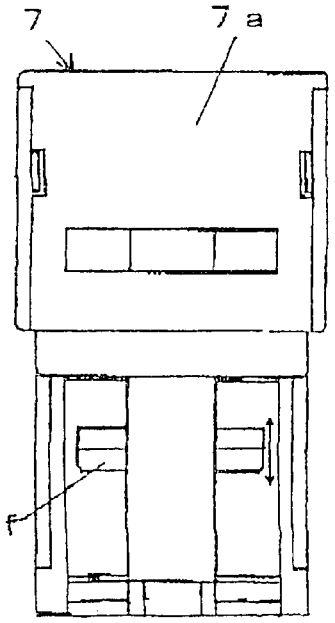
Fig. 6(a)
Prior Art
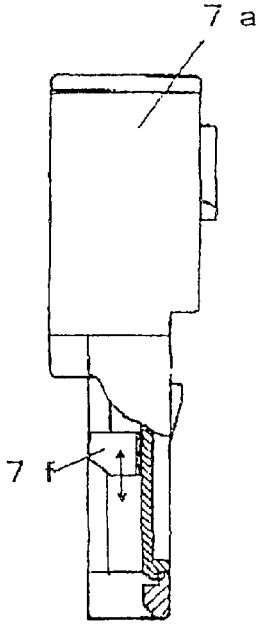
Fig. 6(b)
Prior Art
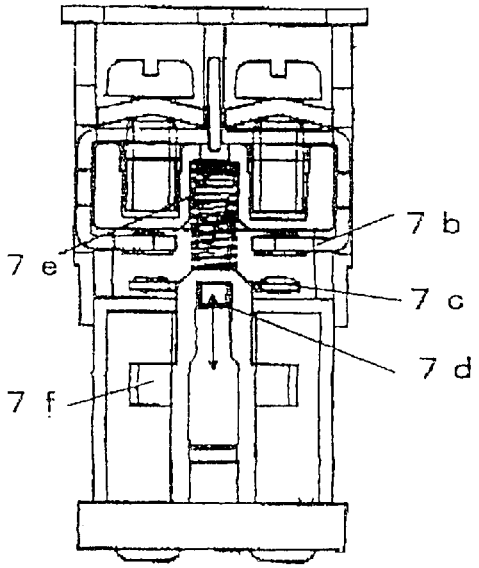
Fig. 6(c)
Prior Art
Fig. 7
Prior Art
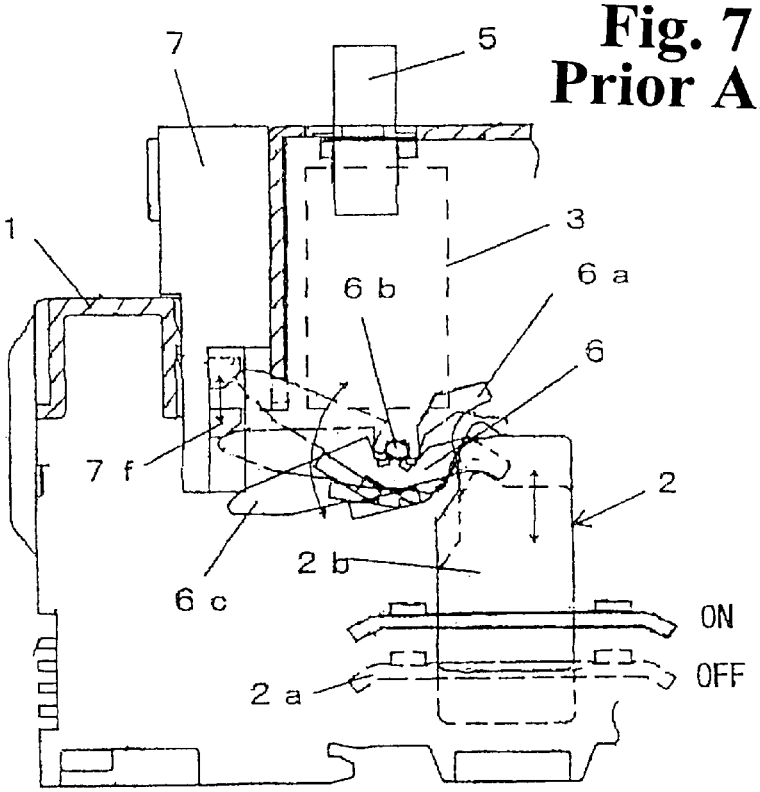

CIRCUIT BREAKER

BACKGROUND OF THE INVENTION AND RELATED ART STATEMENT

The present invention relates to a circuit breaker such as an autobreaker that is applied to the protection of a low-voltage distributing facility from overcurrents, the circuit breaker being provided with an auxiliary switch that acts as an attached device that enables the breaker to detect the ON and OFF status of main circuit contacts as electrical signals.

FIGS. 4(*a*) and 4(*b*) show the construction of a circuit breaker such as an autobreaker having an internal attached switch installed in the main body thereof. In these figures, reference numeral 1 denotes a main body case of the breaker, 2 denotes a main-circuit breaking section incorporated in the case 1, 3 denotes a toggle-link opening and closing mechanism section, 4 denotes an overload current tripping device, 5 denotes an operating handle, 6 denotes an opening and closing lever, described later in detail, 7 denotes a cassette-type attached switch (auxiliary switch for detecting the ON and OFF status of main circuit contacts as electric signals) installed in the main body case 1 as an internal attached device (option), and 8 denotes another attached switch (alarm switch responsive to an output from an alarm output plate that detects the trip operation of the breaker).

The opening and closing mechanism section 3 comprises a toggle link mechanism responsive to an ON/OFF operation of the operating handle 5 or an output from the overload current tripping device 4, and the opening and closing lever 6 that operates synchronously with the toggle link mechanism to open or close the main circuit contacts. Furthermore, the opening and closing lever 6 is a seesaw-type lever that pivots vertically around a support shaft 6*b* as shown in FIG. 5. The opening and closing lever 6 has an operating end 6*a* located opposite. the top of a contact shoe holder 2*b* supporting a movable contact shoe 2*a* of the main circuit contact breaking section 2 as shown in FIG. 7. During an OFF operation, the opening and closing lever 6 is driven clockwise by the force of an urge spring to strike the movable contact shoe holder to open the main circuit contacts. In contrast, during an ON operation, the opening and closing lever 6 is pivoted counterclockwise, causing the movable contact shoe holder 2*b* to recede upward, so that following this motion the main circuit contacts are closed. Furthermore, a tip 6*c* (see FIG. 5) of the other end of the opening and closing lever 6 functions as an opening and closing actuator for attached switch 7, installed in the main body case 1.

In the above construction, when the operating handle 5 is manually set to the ON/OFF position, the opening and closing lever 6 of the opening and closing mechanism section 3 is pivoted to open or close the main circuit contacts of the breaking section 2. Conversely, if an overload current flows through the main circuit, an output signal from the tripping device 4 causes the opening and closing mechanism section 3 to perform a trip operation to open the main circuit contacts, a commonly-known process.

Unlike the above-described process, the attached switch 7 has a fixed contact 7*b*, a bridging movable contact 7*c*, a movable contact shoe holder (vertically movable slider) 7*d*, and a return spring 7*e* for urging and biasing the movable contact 7*c* to an opened and separated position, all these components being incorporated in the case 7*a*. Furthermore, the arm-shaped operating lever 7*f* is connected to the movable contact shoe holder 7*d* and exposed from a front surface of the case 7*a*, as shown in FIGS. 6(*a*) through 6(*c*); the attached switch 7 is a spring return limit switch. The attached switch 7 is installed in an accessory housing section defined in a top surface side of the main body case 1 like a cassette, as shown in FIG. 3. At this installed position, the operating lever 7*f* is located opposite the tip 6*c* of the opening and closing lever 6 of the breaker main body, as illustrated in FIG. 5.

The attached switch 7 operates as follows. In an ON state in which the main circuit contacts of the breaker are closed, the tip of the opening and closing lever 6, which has been pivoted counterclockwise, is lowered to push down the movable contact shoe holder 7*d* of the attached switch 7 using the force of the return spring 7*e*, thereby opening and separating the movable contact shoe 7*c* from the fixed contact shoe 7*b* (the switch contacts are turned off), as illustrated in FIG. 7. Then an OFF signal from this switch allows the detection of the ON state of the main circuit contacts of the breaker. Conversely, in an OFF state in which the trip operation is performed due to a handle operation or the tripping device to open the main circuit contacts, the tip 6*c* of the opening and closing lever 6, which has been pivoted clockwise, thrusts the operating lever 7*f* of the attached switch 7 upward against the force of the return spring 7*e* to close the movable contact 7*c*/fixed contact 7*b*, thereby causing a main circuit contact OFF signal to be output to an exterior. The attached switch 7 in the illustrated example performs ON and OFF operations in response to the opening and closing of the main circuit contacts of the breaker, respectively. In contrast, however, an attached switch that performs the ON operation when the main circuit contacts are closed, and the OFF operation when the contacts are opened, may be used.

With the above construction, in which the attached switch 7 is composed of a spring-return switch and in which the operating lever 7*f* is located opposite the tip 6*c* of the opening and closing lever 6 of the breaker main body, if an error occurs in which the built-in contacts of the attached switch are welded together, then a misdetection problem may result as follows:

If the attached switch 7 operates correctly, the attached switch 7 responds to the pivoting operation of the opening and closing lever 6 of the breaker main body to correctly detect the ON/OFF state of the circuit breaker, as described in FIG. 7. If, however, the built-in contacts of the attached switch 7 are welded together, when the main circuit contacts are turned on again after the trip operation of the circuit breaker, the attached switch 7 remains contact-welded and does not perform the OFF operation, even though the opening and closing lever 6 is pivoted counterclockwise to leave the operating lever 7*f* of the attached switch 7 to recede downward. In this regard, the force of the return spring 7*e* shown in FIG. 6(*c*) is not great enough to cause the welded contacts to be separated from each other. Thus, although the circuit breaker is actually in the ON state, the attached switch 7 continues to output a signal indicating that the main circuit contacts of the breaker are in the OFF state. Consequently, a maintenance worker may mistakenly determine that the circuit breaker is off, and if the worker touches a load-side circuit, he or she may unexpectedly get an electric shock.

The present invention is provided in view of these points, and it is an object thereof to provide an improved circuit breaker in which, even if the built-in contacts of the attached switch installed in the circuit breaker are welded together during operation, the contacts of the welded attached switch are forcibly separated from each other using the force of the pivoting operation of the opening and closing lever of the breaker main body so that the ON/OFF states of the main circuit contacts can be correctly detected.

SUMMARY OF THE INVENTION

To attain the above object, the present invention provides a circuit breaker comprising an opening and closing mechanism section for opening and closing the main circuit contacts according to a handle operation or an output from an overload current tripping device, the opening and closing mechanism section including a seesaw-type opening and closing lever that pivots vertically, the circuit breaker furthermore comprising a cassette-type attached switch installed in an accessory housing section formed in the main body case of the breaker so as to follow the movement of the opening and closing lever to detect the ON or OFF status of the main circuit contacts as an electrical signal, the attached switch having an operating lever moving vertically and placed opposite a tip of the opening and closing lever when the attached switch is installed in the accessory housing section of the main body case, wherein an interlocking hook is attached to the operating lever, which is then engaged in a position where the attached switch is installed with the opening and closing lever of the breaker main body so as to hook a tip thereof, so that motion of the opening and closing lever away from the operating lever of the attached switch is transmitted to the operating lever via the interlocking hook, thereby forcibly operating the attached switch in this direction (a first aspect of the invention).

Furthermore, when the attached switch having the above configuration is installed in an accessory housing section, in order to locate the interlocking hook of the attached switch in a position where the interlocking hook engages with the opening and closing lever, the interlocking hook is shaped like a ring, and an attached switch housing box section formed in the main body case of the breaker has a hook guide at a bottom thereof for guiding, in a position where the attached switch is installed, the interlocking hook to a position where the interlocking hook is engaged with the opening and closing lever.

With the above configuration, if an error occurs in which the built-in contacts of the attached switch are welded together during operation and cannot be opened by themselves, then the force of a pivoting operation of the opening and closing lever associated with a turn-on operation of the circuit breaker is used to forcibly separate the contacts of the attached switch in order to recover from the contact welding. Consequently, the attached switch is prevented from outputting misdetection signals, thereby increasing the reliability of the breaker.

BRIEF DESCRIPTION OF THE DRAWINGS

FIGS. 1(*a*) to 1(*c*) are views illustrating how an opening and closing lever and an attached switch are mutually linked in a circuit breaker according to an embodiment of the present invention, wherein FIG. 1(*a*) illustrates how the attached switch is installed in a main body case, and FIGS. 1(*b*) and 1(*c*) illustrate how the circuit breaker is turned on and off, respectively;

FIGS. 6(*a*) to 6(*c*) are views showing an existing construction of an attached switch installed in the circuit breaker in FIGS. 4(*a*) and 4(*b*), wherein FIG. 6(*a*) is a front view, FIG. 6(*b*) is a partly sectional side view, and FIG. 6(*c*) shows an internal mechanism; and FIG. 7 is a view illustrating a linking operation between the attached switch and an opening and closing lever of the circuit breaker, shown in FIGS. 6(*a*) to 6(*c*).

DETAILED DESCRIPTION OF PREFERRED EMBODIMENTS

Figure 4A:
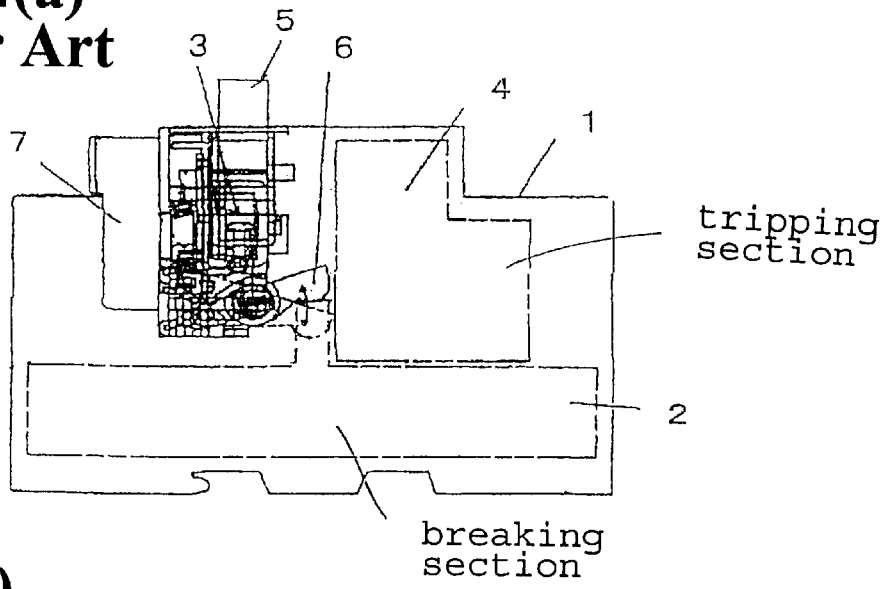
Fig. 4(a) Prior Art
FIGS. 4(*a*) and 4(*b*) are schematic views showing a construction of the circuit breaker in which the present invention is implemented, wherein FIG. 4(*a*) is a side view, and FIG. 4(*b*) is a top plan view.
Figure 4B:
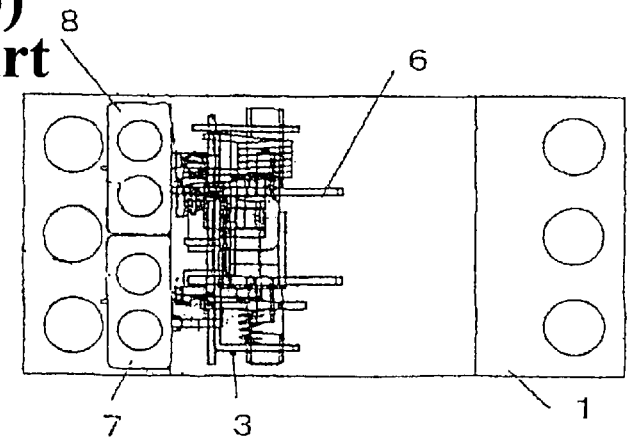
Fig. 4(b) Prior Art
Figure 5:
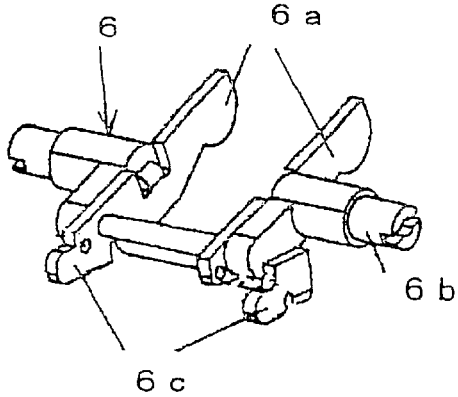
Fig. 5 Prior Art
FIG. 5 is a perspective view showing the appearance of the opening and closing lever in FIGS. 4(*a*) and 4(*b*)

An embodiment of the present invention will be described below with reference to FIGS. 1(*a*) to 3. In the figures for the embodiment, those members which correspond to FIGS. 4(*a*) to 7 are denoted by the same reference numerals, and detailed description thereof is omitted.

In the illustrated embodiment, compared to the conventional structure, the operating lever 7*f* of the attached switch 7 additionally has an interlocking ring-shaped hook 7*g*. Furthermore, an accessory housing section formed in the main body case 1 of the breaker has a hook guide 9 formed at the bottom thereof for guiding the interlocking hook 7*g* to a predetermined position.

Here, the interlocking hook 7*g* is obtained by molding a metal wire of a spring property into a U-shape, as shown in FIG. 2(*a*). The interlocking hook 7*g* is suspended in a bail-like hanging position by fitting support shaft portions thereof in shaft holes formed in a left-end surface and a right-end surface of the operating lever 7*f* of the attached switch 7, the support shaft portions being formed by bending the left and right sides inward and folding both ends inward. Furthermore, as shown in FIG. 2(*d*), the operating lever 7*f* has tapered step portions 7*f*-1 formed in the left and right end surfaces, causing it to bulge out in front of the corresponding shaft holes. Accordingly, the interlocking hook 7*g* can be freely held in the hanging position.

Figure 2A:
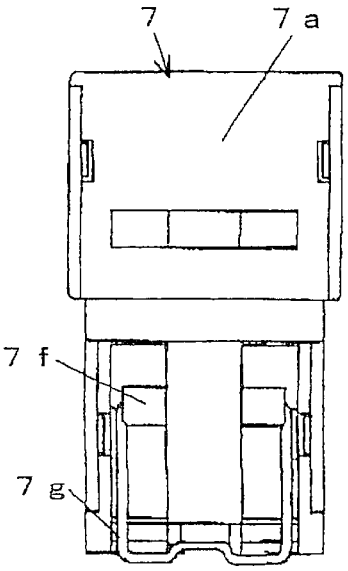
FIGS. 2(*a*) to 2(*d*) are views showing a construction of the attached switch in FIGS. 1(*a*) to 1(*c*), wherein FIG. 2(*a*) is a front view, FIG. 2(*b*) is a partly sectional side view, FIG. 2(*c*) shows an internal mechanism, and FIG. 2(*d*) is a partial enlarged perspective view of an operating lever.
Figure 2B:
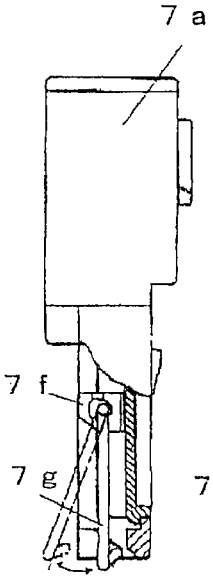
Figure 2C:
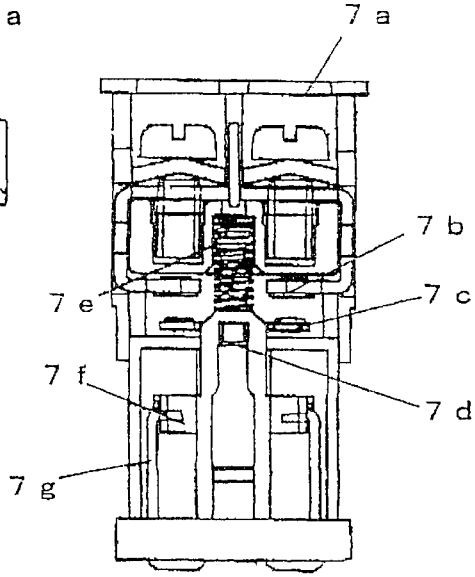
Figure 2D:
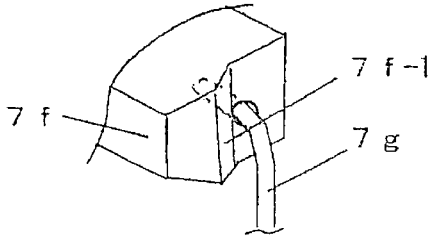
Figure 3:
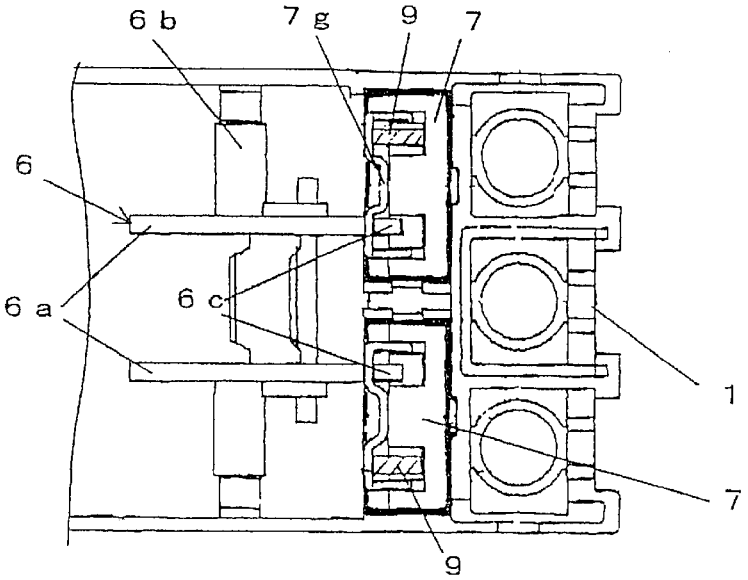
FIG. 3 is a bottom view illustrating how the attached switch is installed, corresponding to FIG. 1(*b*)

Conversely, the accessory housing section formed in the main body case 1 of the circuit breaker has an inclined cam-shaped hook guide 9 formed integrally with the case 1 so that it protrudes from a bottom surface of the accessory housing section, as shown in FIGS. 1(*a*) to 1(*c*) and FIG. 3. When the attached switch 7 is inserted and set in the accessory housing section of the main body case 1 like a cassette, this hook guide 9 serves to guide the tip of the interlocking hook 7*g* along a cam surface to lock the hook 7*g* on the tip 6*c* of the opening and closing lever 6. As shown in FIG. 3, the hook guide 9 is formed offset from the tip 6*c* so that it does not interfere with the opening and closing lever 6 when the attached switch 7 is installed in the main body case 1.

Due to the above design, when the attached switch 7 is inserted into the accessory housing section from above of the case 1 while the breaker is off (the tip 6*c* of the opening and closing lever 6 has been elevated) as shown in FIG. 1(*a*), the interlocking hook 7*g*, which is retained in its hanging position, passes by the tip side (the left of the drawing) of the opening and closing lever 6 without abutting against the tip 6*c* thereof, and then the tip of the hook abuts against the hook guide 9, formed on the bottom side. When the attached switch 7 is pushed in further, the hook 7*g* shifts from its hanging position, indicated by a solid line in the figure, to its inclined position, indicated by a broken line therein, along the cam surface of the hook guide 9. In an installed position, shown in FIGS. 1(*b*) and 3, the bottom end of the interlocking hook 7*g* reaches vertical surfaces at the tip of the hook guide 9, moves inward beyond the tip 6*c* of the opening and closing lever 6, and then stops in this position. At the same time, the operating lever 7*f* abuts against the tip 6*c* of the opening and closing lever 6 and is pushed up, thereby causing the attached switch 7 to detect that the built-in contacts have been closed to turn off the breaker.

Conversely, when the handle is then moved for a turn-on operation to close the main circuit contacts of the circuit breaker, the opening and closing lever 6 is pivoted counterclockwise, and during this movement, the tip 6*c* of the lever catches on the interlocking hook 7*g* to pull it down, while the operating lever 7*f*, which is linked with the interlocking hook 7*g*, is forcibly pulled down to open the built-in contacts of the switch 7, as shown in FIG. 1(*c*). Thus, the attached switch 7 outputs a detection signal indicating that the circuit breaker has been turned on.

In this case, even if an error occurs in which the built-in contacts of the attached switch 7 are welded together during conduction and cannot open by themselves using the force of the return spring 7*e*, since the opening and closing lever 6 pulls down the interlocking hook 7*g* when the circuit breaker is turned on, the built-in contacts of the attached switch 7 are forcibly separated and opened. As a result, the ON status of the circuit breaker can be duly detected.

Furthermore, in the state shown in FIG. 1(*c*), when the main circuit contacts are opened due to a trip operation of the breaker or an OFF operation of the handle, the opening and closing lever 6 is inverted clockwise, thrusting the operating lever 7*f* of the attached switch 7 upward, thereby inverting the attached switch 7, as shown in FIG. 1(*b*). If an error occurs in which the main circuit contacts of the breaker are welded together or in which the opening and closing lever cannot be returned to the position shown in FIG. 1(*b*) due to a fault in the opening and closing mechanism section 3 or the like, and if the main circuit contacts thus cannot be opened even with an OFF operation of the circuit breaker, the tip 6*c* of the opening and closing lever 6 does not push the operating lever 7*f* of the attached switch 7, so that the attached switch 7 is safely prevented from being inverted to output an erroneous signal.

As described above, the present invention provides a circuit breaker comprising an attached switch installed in a main body case of the circuit breaker and opened and closed by an opening and closing lever provided in an opening and closing mechanism section of the breaker main body, the attached switch including a vertically moving operating lever, the operating lever being located opposite the tip of the opening and closing lever when the attached switch is installed in an accessory housing section of the main body case, wherein the operating lever has an interlocking hook additionally provided therein and shaped like a ring, wherein the interlocking hook is linked with the opening and closing lever so as to hook the tip thereof when the attached switch is located in its installed position, and wherein an attached switch housing box section formed in the main body case of the breaker has a hook guide at a bottom thereof for guiding, in a position where the attached switch is installed, the interlocking hook to a position where the interlocking hook engages the opening and closing lever. Accordingly, with the attached switch installed in the main body case of the breaker, the interlocking hook can be correctly set in a position where it engages with the opening and closing lever. Even if an error occurs in which built-in contacts of the attached switch are welded together during operation and cannot open by themselves, the contacts of the attached switch can be forcibly separated from each other to restore the normal operational status using the force of a pivoting operation of the opening and closing lever associated with a turn-on operation of the circuit breaker. Consequently, the attached switch is prevented from outputting misdetection signals, thereby increasing the reliability of the breaker.

What is claimed is:

1. A circuit breaker comprising:

main circuit contacts;

an opening and closing mechanism section for opening and closing the main circuit contacts, the opening and closing mechanism section including a seesaw-type opening and closing lever that pivots vertically, and a cassette-type attached switch installed in an accessory housing section located in a main body case of the circuit breaker so as to follow a movement of said opening and closing lever to detect ON or OFF status of the main circuit contacts as an electric signal, said attached switch having an operating lever moving vertically and placed opposite a tip of the opening and closing lever when the attached switch is installed in the accessory housing section of the main body case, said operating lever having an interlocking hook thereon linked with the opening and closing lever so as to hook the tip thereof when the attached switch is in an installed position.

2. A circuit breaker according to claim 1, further comprising an overload current tripping device, said circuit breaker opening and closing the main circuit contacts in response to a handle operation or an output from the overload current tripping device.

3. A circuit breaker according to claim 2, wherein said interlocking hook is ring-shaped, said circuit breaker further comprising an attached switch housing box section formed in the main body case of the circuit breaker, said attached switch housing box section including guide means for guiding said interlocking hook to a position where the interlocking hook engages the opening and closing lever.

4. A circuit breaker according to claim 3, wherein said guide means is formed of a hook guide provided at a bottom of the attached switch housing box section.

5. A circuit breaker according to claim 4, wherein said interlocking hook is a wire bail pivotally mounted on said operating lever and depending downwardly therefrom.

6. A circuit breaker according to claim 5, wherein said hook guide comprises an inclined guide member positioned to engage said interlocking hook upon a vertical downward movement thereof to pivot said interlocking hook into the position to be engaged by said tip of said opening and closing lever.

* * * * *